US009433247B1

(12) United States Patent
Harris

(10) Patent No.: US 9,433,247 B1
(45) Date of Patent: Sep. 6, 2016

(54) WEIGHT-DISPLACING KNEE PAD

(71) Applicant: Stephen John Harris, Fort Pierce, FL (US)

(72) Inventor: Stephen John Harris, Fort Pierce, FL (US)

( * ) Notice: Subject to any disclaimer, the term of this patent is extended or adjusted under 35 U.S.C. 154(b) by 0 days.

(21) Appl. No.: 14/675,901

(22) Filed: Apr. 1, 2015

(51) Int. Cl.

| | |
|---|---|
| ***A41D 13/05*** | (2006.01) |
| ***A41D 13/015*** | (2006.01) |
| ***A41D 13/06*** | (2006.01) |
| *A41D 13/00* | (2006.01) |

(52) U.S. Cl.
CPC ..... *A41D 13/065* (2013.01); *A41D 13/015* (2013.01); *A41D 13/0543* (2013.01); *A41D 13/00* (2013.01)

(58) Field of Classification Search
CPC ..... A41D 13/065; A41D 13/0568; A41D 13/0556; A41D 13/0153; A41D 13/0575; A63B 2071/125; A63B 2071/1258; A63B 71/1225; A63B 2208/0223; A47L 13/62; A47G 27/0493
See application file for complete search history.

(56) References Cited

U.S. PATENT DOCUMENTS 1,117,168 A * 11/1914 Crowley ..... A41D 13/065 2/24
1,404,489 A 1/1922 Snow
1,510,325 A 9/1924 Landon
1,571,088 A * 1/1926 Buchanan ..... A41D 13/0568 2/24
1,624,129 A * 4/1927 Barrett ..... A63B 71/1225 2/22
2,093,888 A * 9/1937 Holtje ..... A41D 13/065 182/230
2,124,158 A * 7/1938 Turner ..... A41D 13/0568 2/24
2,195,817 A * 4/1940 Johnson ..... A41D 13/065 2/24
2,363,058 A * 11/1944 Gill ..... A41D 13/0568 2/24
2,432,565 A * 12/1947 Ferguson ..... A41D 13/0568 2/24
2,484,494 A * 10/1949 Ferguson ..... A41D 13/0568 2/24
2,759,189 A * 8/1956 Cole ..... A41D 13/0568 2/24

(Continued)

FOREIGN PATENT DOCUMENTS

GB 745558 2/1956

*Primary Examiner* — Bobby Muromoto, Jr.
(74) *Attorney, Agent, or Firm* — The Concept Law Group, P.A.; Scott D. Smiley; Yongae Jun

(57) ABSTRACT

A weight-displacing knee pad is disclosed that includes a knee body having an inner member substantially enclosed an outer cushion member. The outer cushion member includes an exterior surface defining a knee-receiving cavity and a shin-receiving surface and at least a portion of the inner member includes a shin-support body disposed beneath the shin-receiving surface. At least a portion of the shin-support body has a triangular cross-section with an apex extending upwardly toward the shin-receiving surface. The inner member is made of a different material than the outer cushion member. The weight-displacing knee pad also includes a forward knee-movement barrier with a forward knee-barrier support body defined by at least a portion of the inner member.

19 Claims, 5 Drawing Sheets

(56) References Cited

U.S. PATENT DOCUMENTS 3,025,526 A * 3/1962 Ramon ..... A41D 13/0568 182/230
3,168,746 A * 2/1965 Smith ..... A41D 13/0575 2/23
4,627,108 A * 12/1986 Jarvinen ..... A41D 13/065 2/22
4,685,153 A * 8/1987 Sims ..... A61F 13/06 2/24
4,723,322 A * 2/1988 Shelby ..... A41D 13/065 2/16
4,772,071 A * 9/1988 Richards ..... A47C 16/04 2/24
4,876,745 A * 10/1989 Richards ..... A41D 13/065 2/24
5,031,240 A 7/1991 Nierhaus
5,073,986 A * 12/1991 Farrago ..... A41D 13/065 2/22
5,090,055 A * 2/1992 McElroy ..... A41D 13/065 2/24
5,865,507 A * 2/1999 Earl, Jr. ..... A47C 9/027 280/32.6
D406,406 S * 3/1999 Hettwer ..... D29/120.1
6,128,779 A * 10/2000 Goldsmith ..... A41D 13/065 2/22
6,256,787 B1 * 7/2001 Tyler ..... A41D 13/0568 2/22
6,427,239 B1 8/2002 Worden
6,438,754 B1 8/2002 Canney
6,578,217 B1 * 6/2003 Roberson ..... A47C 16/04 224/155
D492,068 S 6/2004 Peterson et al.
6,820,279 B2 * 11/2004 Lesosky ..... A41D 13/065 2/24
6,883,177 B1 * 4/2005 Ouellette ..... A41D 13/065 2/24
6,913,583 B2 7/2005 Jestrabek-Hart
7,062,787 B1 * 6/2006 Shircliff ..... A41D 13/065 2/24
7,096,508 B2 * 8/2006 Lesosky ..... A41D 13/065 2/24
7,194,770 B1 3/2007 Fecenko
7,197,770 B1 4/2007 Warren
7,448,088 B2 * 11/2008 Miller ..... A41D 13/065 2/24
7,735,148 B1 * 6/2010 Turman ..... A47G 27/0493 2/22
7,950,067 B2 5/2011 Williams, Jr.
8,034,010 B1 * 10/2011 Sauer ..... A41D 13/065 128/95.1
8,141,170 B2 3/2012 Paterno
8,220,073 B2 7/2012 Lopez et al.
8,752,214 B1 6/2014 Maldonado
2004/0111780 A1 * 6/2004 Lesosky ..... A41D 13/065 2/24
2006/0041985 A1 * 3/2006 Godshaw ..... A41D 13/065 2/24
2007/0017005 A1 * 1/2007 Shircliff ..... A41D 13/065 2/240
2007/0050877 A1 * 3/2007 Rampersad ..... A41D 13/0556 2/23
2007/0161480 A1 * 7/2007 Trancart ..... A61H 1/0237 482/74
2011/0094001 A1 4/2011 Maldonado

* cited by examiner

100

104

404

WEIGHT-DISPLACING KNEE PAD

FIELD OF THE INVENTION

The present invention relates generally to knee pads, and more particularly relates to a knee pad operable to distribute weight from the knee to the shinbone.

BACKGROUND OF THE INVENTION

It is well-known that many knee pads in the current art are uncomfortable. In particular, many knee pads are not designed for users, such as carpet layers or floor installers that spend a great deal of their work day on their knees while leaning forward in order to perform work. Existing knee pads often include padding for the knee area. Unfortunately, even with the padding, there is a great deal of stress on the knees due to the constant weight of the user's body being largely directed on the knee area for a long period of time. In addition, because many existing knee pads are not designed for these work related tasks, the knee pads are constructed such that users that kneel for long periods of time while leaning forward, often find that their knees slip forward and outside of the knee pad. This requires these users to re-secure the knee pads to the knee area.

U.S. Pat. No. 6,438,754, issued Aug. 27, 2002 to Kevin Patrick Canney (herinafter "the Canney reference") discloses a knee pad protector that attempts to take all of the weight bearing pressure off the knee and displace it across the lower leg so that the full weight of the user is not on the knee. The Canney reference describes a foam body with a channel running longitudinally through the center that conforms to the shape of the lower leg. The foam body supports the lower leg but stops before the knee. The foam body is attached to a rigid bottom means and both are secured to the user's leg with straps. Unfortunately, the knee pad of the Canney reference has drawbacks. In particular, workers who spend a great deal of time on their knees are usually leaning forward at an angle while on their knees. This angular position directs the weight of the user forward such that the user's leg would be pulled out of the knee pad protector disclosed in the Canney reference. The straps would have to be extremely tight, likely to the point of cutting off blood circulation in order to remain secured to the user's leg while the weight of the user is being directed forward. Also, when using the knee pad protector described in the Canney reference the forward leaning position of the user would likely throw the user off balance and result in the user toppling forward. The rigid bottom means would have to be a substantial length to sufficiently balance the weight of an adult. Further, FIG. 1 of the Canney reference is not drawn to scale and is somewhat deceiving. In reality, an adult in the position depicted in FIG. 1 of the Canney reference would create a space between the ground surface and the user's ankle that is approximately 6 inches. Therefore, the foam body would have to be very thick in order to provide sufficient cushion for the user's lower leg, adding to the manufacturing costs of the design.

U.S. Pat. No. 6,427,239, issued Aug. 6, 2002 to Michael Worden (hereinafter "the Worden reference") discloses a knee pad including a lower leg support adapted to closely engage a lower leg of a user and a knee cover that conforms to the shape of a knee, but is physically separate from the knee so as to prevent the patella from pushing against the femur. The Worden reference states that when a user kneels the user's weight is supported more by the lower leg support than the knee cover. Unfortunately, the knee pad of the Worden reference has drawbacks. In particular, as can be seen in FIG. 7 of the Worden reference, a user in a forward leaning, kneeling position would tend to slip forward outside of the knee pad with his/her knees hitting the ground surface. In addition, the knee pad disclosed in the Worden reference is designed such that the user's foot must be in an upright extended position, as can be seen in FIG. 7 of the Worden reference. Accordingly, the knee pad disclosed in the Worden reference would not function as intended with the user's foot in a horizontal resting position. Further, because the Worden knee pad functions as a cantilever, the strap 12 would be required to be uncomfortably tight around the user's ankle.

Therefore, a need exists to overcome the problems with the prior art as discussed above.

SUMMARY OF THE INVENTION

The invention provides a weight-displacing knee pad that overcomes the hereinafore-mentioned disadvantages of the heretofore-known devices and methods of this general type and that distributes the user's weight from the knee to the shinbone and lower leg area.

With the foregoing and other objects in view, there is provided, in accordance with the invention, a weight-displacing knee pad having a knee-pad body including an inner member and an outer cushion member, the outer cushion member including an exterior surface defining a knee-receiving cavity and a shin-receiving surface and at least a portion of the inner member having a shin-support body disposed beneath the shin-receiving surface. At least a portion of the shin-support body includes a triangular cross-section with a first apex extending upwardly toward the shin-receiving surface. The inner member is of a different material than the outer cushion member.

In accordance with another feature, the inner member is of a material that is more rigid than a material from which the outer cushion member is made of.

In accordance with yet another feature, the inner member is substantially enclosed by the outer cushion member.

In accordance with a further feature, the outer cushion member is molded onto an exterior surface of the inner member so as to substantially enclose the inner member.

In accordance with yet a further feature, the knee-pad body further includes a forward knee-movement barrier having a ridge having a height relative to a bottom-most surface of the knee-receiving cavity, the height being sufficient to prevent a user's knee from moving in a forward direction outside of the knee-receiving cavity when the user is in a forward leaning, kneeling position with the user's knee inserted into the knee-receiving cavity and the user's shin resting on the shin receiving surface.

In accordance with another feature, the forward knee-movement barrier includes a forward knee-barrier support body disposed beneath an upper surface of the ridge, the forward knee-barrier support body defined by at least a portion of the inner member and including a triangular cross-section with a second apex extending upwardly toward the ridge.

In accordance with another feature, the shin-support body and the forward knee-barrier support body of the inner member are formed integrally with one another.

In accordance with another feature, the knee-receiving cavity defines a distance between a bottom-most surface of the cavity and an upper rim of the cavity; and the first apex of the shin-support body extends upwardly to least one-half of the distance.

In accordance with a further feature, an embodiment of the present invention also includes a concave-shaped wall defining the knee-receiving cavity, the inner member extending circumferentially about the concave-shaped wall and including a pair of inner member sidewalls on opposing sides of the concave-shaped wall, the pair of inner member sidewalls and the shin-support body formed integrally with one another.

In accordance with yet a further feature, the inner member circumscribes the knee-receiving cavity so as to define an aperture for receiving at least a portion of the outer cushion member therethrough, the portion the outer cushion member forming a rigid-free cushion zone for a user's knee when inserted within the knee-receiving cavity.

In accordance with a further feature of the present invention, a weight-displacing knee pad is disclosed that includes an outer cushion member, the outer cushion member having an exterior surface defining a knee-receiving cavity and a shin-receiving surface; and an inner member of a substantially rigid material. The inner member has a shin-support body disposed beneath the shin-receiving surface of the outer cushion member so as to define a shin support zone; and the inner member circumscribes the knee-receiving cavity so as to define an aperture for receiving at least a portion of the outer cushion member therethrough, the portion of the outer cushion member forming a rigid-free cushion zone for a user's knee when inserted within the knee-receiving cavity.

In accordance with a further feature of the present invention, the outer cushion member is of a foam material.

In accordance with another feature of the present invention, a weight-displacing knee pad is disclosed that includes an outer cushion member, the outer cushion member having an exterior surface defining a knee-receiving cavity and a shin-receiving surface; and an inner member substantially enclosed by the outer cushion member. At least a portion of the inner member has a shin-support body disposed beneath the shin-receiving surface, at least a portion of the shin-support body including a triangular cross-section with a first apex extending upwardly toward the shin-receiving surface. A forward knee-movement barrier is disposed on a side of the knee-receiving cavity that is opposite a side of the knee-receiving cavity where the shin-receiving surface is disposed. The forward knee-movement barrier includes a forward knee-barrier support body defined by at least a portion of the inner member and includes a triangular cross-section with a second apex extending upwardly toward a ridge of the forward knee-movement barrier.

Although the invention is illustrated and described herein as embodied in a weight-displacing knee pad, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the weight-displacing knee pad.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
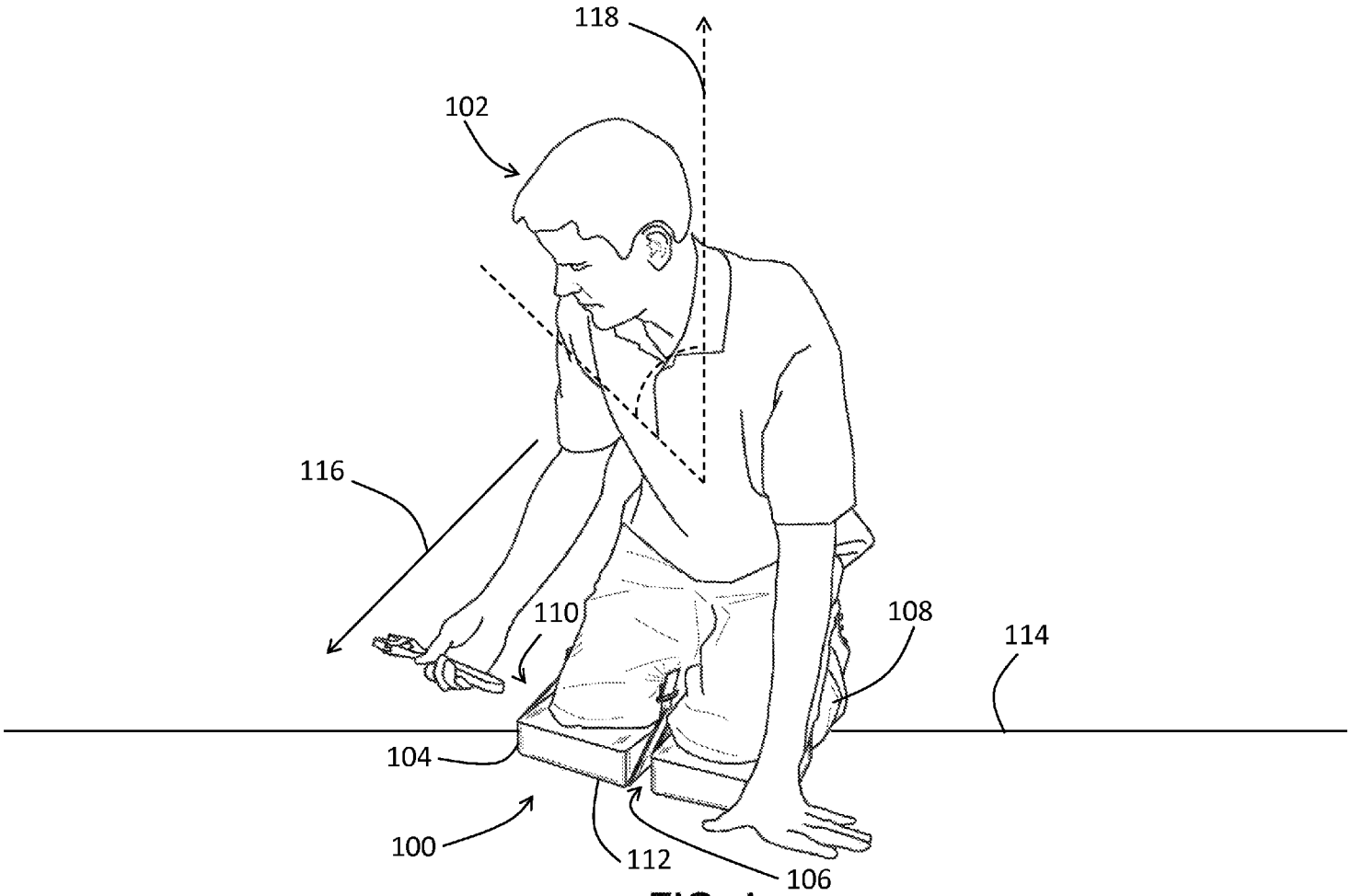
FIG. 1 is a perspective view of a user wearing a weight-displacing knee pad in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient knee pad. Embodiments of the invention provide a knee pad that displaces the weight of the user from the knee area to the shin area. In addition, embodiments of the invention provide for a knee pad having a rigid inner member that conforms to the shape of the knee and that is substantially enclosed by a soft outer cushion member. In embodiments, the rigid inner member provides support for the user to rest his/her shin, while the soft outer cushion member supports the knee. Accordingly, the user may shift his/her body weight to the shin, while the knee is able to rest on the soft outer cushion layer without his/her body weight bearing down on the knee. In a further embodiment, the inventive knee pad is formed by pouring liquid foam into a mold including the rigid inner member so that the foam forms over the rigid inner member substantially enclosing the inner rigid member as it hardens. This results in a knee pad body with a shin-support section where the rigid inner member provides rigid to semi-rigid support and a soft, pliable knee-receiving cushion section. In yet a further embodiment, the knee pad includes a forward lip or ridge that prevents the knee from slipping forward outside of the knee pad when the user is kneeling and leaning forward at an angle. In yet another embodiment, the knee pad includes a strap that clamps onto the inner and outer seams of the user's pant legs to secure the knee pad to the user's knee and shin area.

Referring now to FIG. 1, one embodiment of the present invention is shown in a perspective view. FIG. 1 shows several advantageous features of the present invention, but, as will be described below, the invention can be provided in several shapes, sizes, combinations of features and components, and varying numbers and functions of the components. The first example of a weight-displacing knee pad 100, as shown in FIG. 1 in use by a user 102, includes a knee-pad body 104 and a pair of coupling members 106 that are operably configured to selectively couple the knee-pad body 104 to pant legs 108 at a knee area 110 of the user 102.

Figure 2:
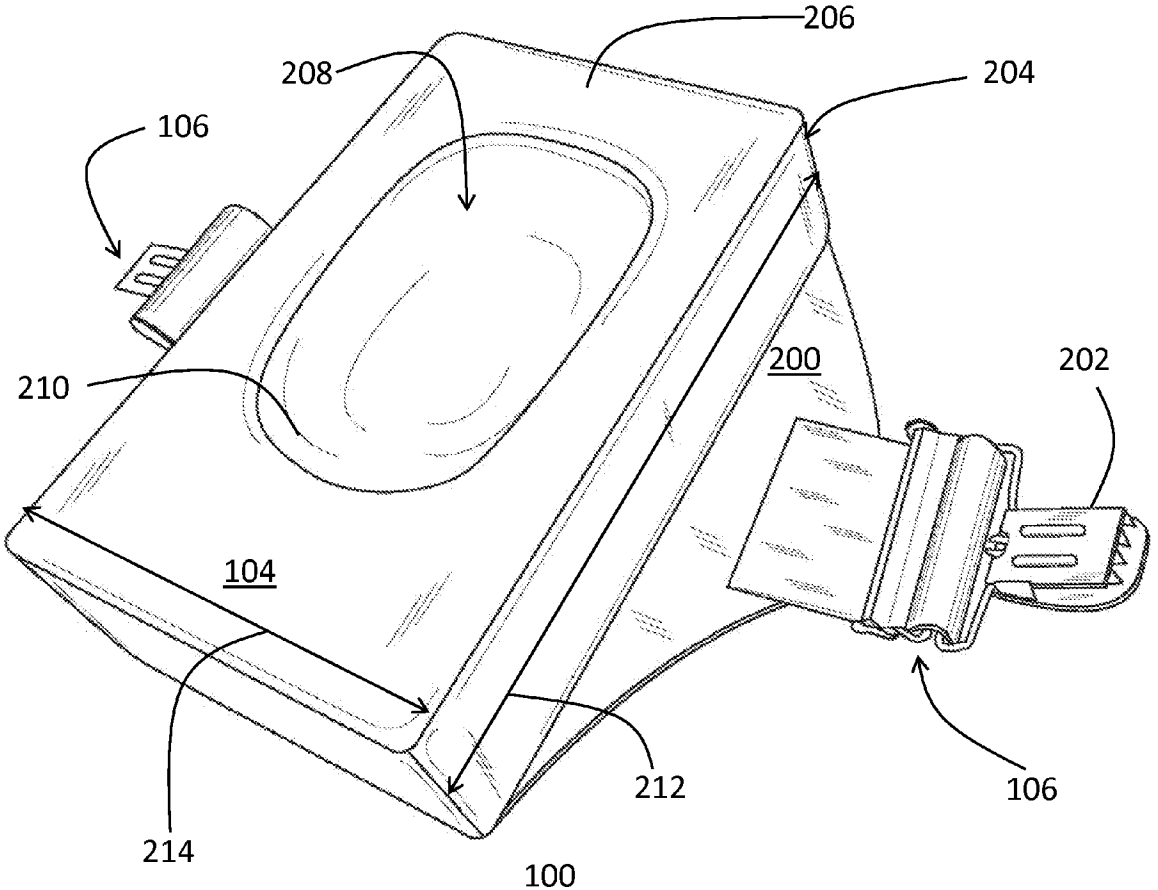
FIG. 2 is a top perspective view of the weight-displacing knee pad of FIG. 1 in accordance with the present invention.

Referring to FIG. 2, the weight-displacing knee pad 100 is shown in a top perspective view, uncoupled from the user 102 (FIG. 1). In one embodiment, each of the pair of coupling members 106 includes a wing 200 and a clip 202. In another embodiment, each of the pair of coupling members 106 is disposed on opposing sides of the knee-pad body 104. In another embodiment, the clip 202 is disposed on one end of the wing 200 while an edge of the knee-pad body 104 is disposed on an opposing end of the wing 200. In another embodiment, the wing 200 is made of a rubber material. In yet another embodiment, the wing 200 is made of a non-rubber material. In a further embodiment, the weight-displacing knee pad 100 may not include the wings 200.

Referring now to FIGS. 1-2, the wing 200 that is disposed on each side of the knee-pad body 104 may also be coupled to a rubber shield 112 that covers a bottom surface of the knee-pad body 104 so as to be a floor-contacting portion of the weight-displacing knee pad 100. Advantageously, the rubber shield 112 may provide a frictional surface that aids in preventing the weight-displacing knee pad 100 from sliding forward on a floor surface 114 as the user 102 leans forward in a kneeling position, as can be seen in FIG. 1. In other embodiments, the rubber shield 112 can be made of other materials that provide a frictional surface to prevent forward sliding movement when in use on the floor surface 114.

In one embodiment, the clip 202 may include a pair of clamping teeth operably configured to clamp onto the inner and outer seams of the pant legs 108. In another embodiment, the clamping teeth may include a lever that folds down over the clamping teeth, similar to suspender clips. In yet a further embodiment, the clip 202 may be formed as other types of attachment devices for selectively securing the knee-pad body 100 to the user 102.

In one embodiment, the knee-pad body 104 includes an outer cushion member 204 having an exterior surface 206. In another embodiment, at least a portion of the exterior surface 206 defines a knee-receiving cavity 208. In yet another embodiment, the exterior surface 206 defines a concave-shaped wall 210 that can be considered a cushioning wall made of a soft material, such as a soft foam material. In yet another embodiment, the outer cushion member 204 is made of polyurethane foam. In a further embodiment, the polyurethane foam has a density of about 7 to 8 lbs. In yet a further embodiment, the outer cushion member 204 is a made of another pliable, flexible material to provide a soft cushion for the user's knee. In one embodiment, the knee-pad body 104 is about 7.5 inches in length 212 and about 5 inches in width 214. In other embodiments, the knee-pad body 104 may include other dimensions to provide a length and width sufficient to have a knee-receiving cavity 208 that conforms to the size and shape of an average-sized knee and a shin support section for receiving a shinbone of the user 102 thereon, as will be discussed herein in more detail below.

Figure 3:
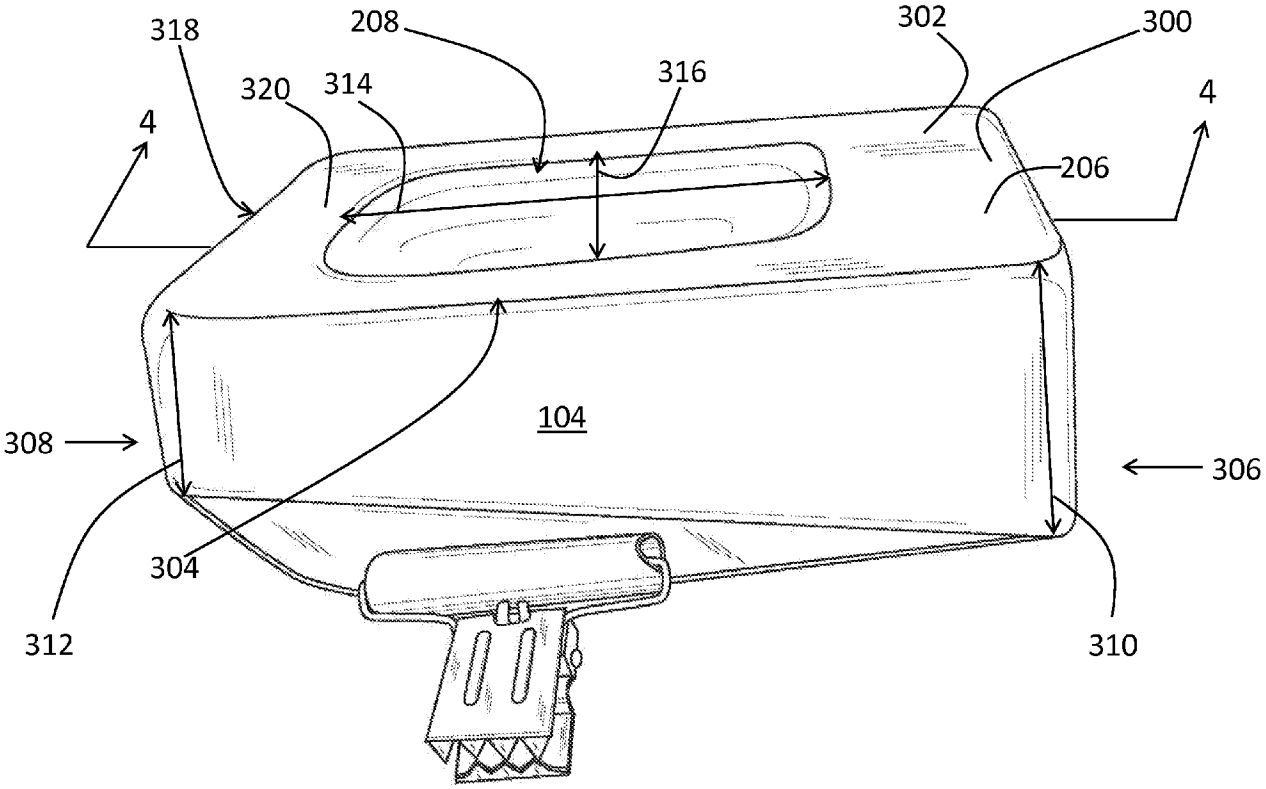
FIG. 3 is a side perspective view of the weight-displacing knee pad of FIG. 1 in accordance with the present invention.

Referring to FIG. 3, the weight-displacing knee pad 100 is illustrated in a side perspective view. In one embodiment, at least a portion of the exterior surface 206 of the knee-pad body 104 defines a shin-receiving surface 300 operably configured as a support surface for the user 102 to rest his shin thereon (see FIG. 1). In another embodiment, a top portion 302 of the exterior surface 206 defines a tapered edge 304. In another embodiment, the tapered edge 304 defining a thickness of the knee-pad body 104 that becomes smaller as the tapered edge 304 moves from the shin-receiving surface 300 at one end 306 of the knee-pad body 104, to the opposing end 308 of the knee-pad body 104. Advantageously, the thick end 306 provides sufficient support for the user's shin to rest comfortably thereon, even with the user's body weight bearing down on the shin. In one embodiment, the thick end 306 is about 2.25 inches in thickness 310 at the thickest part, and the opposing, thin end 308 is about 1.5 inches in thickness 312 at the thinnest part. In another embodiment, the thick end 306 and the opposing end 308 are outside of this range of thickness. In yet another embodiment, the thicknesses defined by the tapered edge 304 will depend on the material properties of the material selected for the knee-pad body 104. Preferably, the thickness will be selected so that the materials in the knee-pad body 104 will provide sufficient and comfortable support as the user's body weight is shifted to the user's shin while it rests on the shin-receiving surface 300. In a further embodiment, the knee-receiving cavity 208 can be considered an indentation or recess into the knee-pad body 104. In yet a further embodiment, the knee-receiving cavity 208 is about 4.5 inches in length 314 and about 3 inches in width 316. In other embodiments, the length and width dimensions for the knee-receiving cavity 208 are outside of this range.

In one embodiment, the knee-pad body 104 further includes a forward knee-movement barrier 318. In another embodiment, the forward knee-movement barrier 318 is disposed on a side of the opposing, thin end 308 defined by the tapered edge 304. Stated another way, the forward knee-movement barrier 318 is disposed on a side of the knee-receiving cavity 208 that is opposite a side of the knee-receiving cavity 208 where the shin-receiving surface 300 is disposed. Advantageously, the forward knee-movement barrier 318 provides a barrier to prevent the user's knee from slipping forward, outside of the knee-receiving cavity 208 when the user 102 (see FIG. 1) is in a kneeling position, leaning forward. Many prior art knee pads do not include a barrier that would be sufficient to prevent the user's knee from slipping outside the knee pad in said forward leaning position, which directs the weight of the user forward in a downward, angular direction. In a further embodiment, the forward knee-movement barrier includes a ridge 320. As used herein, the term "ridge" is defined as an upper section of the knee-pad body 104 that is elevated relative to a bottom-most surface of the knee-receiving cavity 208. As used herein, the term "bottom-most" is intended to indicate a surface or absolute end of an object or area that is closest to a ground surface when the object or area is in typical use.

Figure 4:
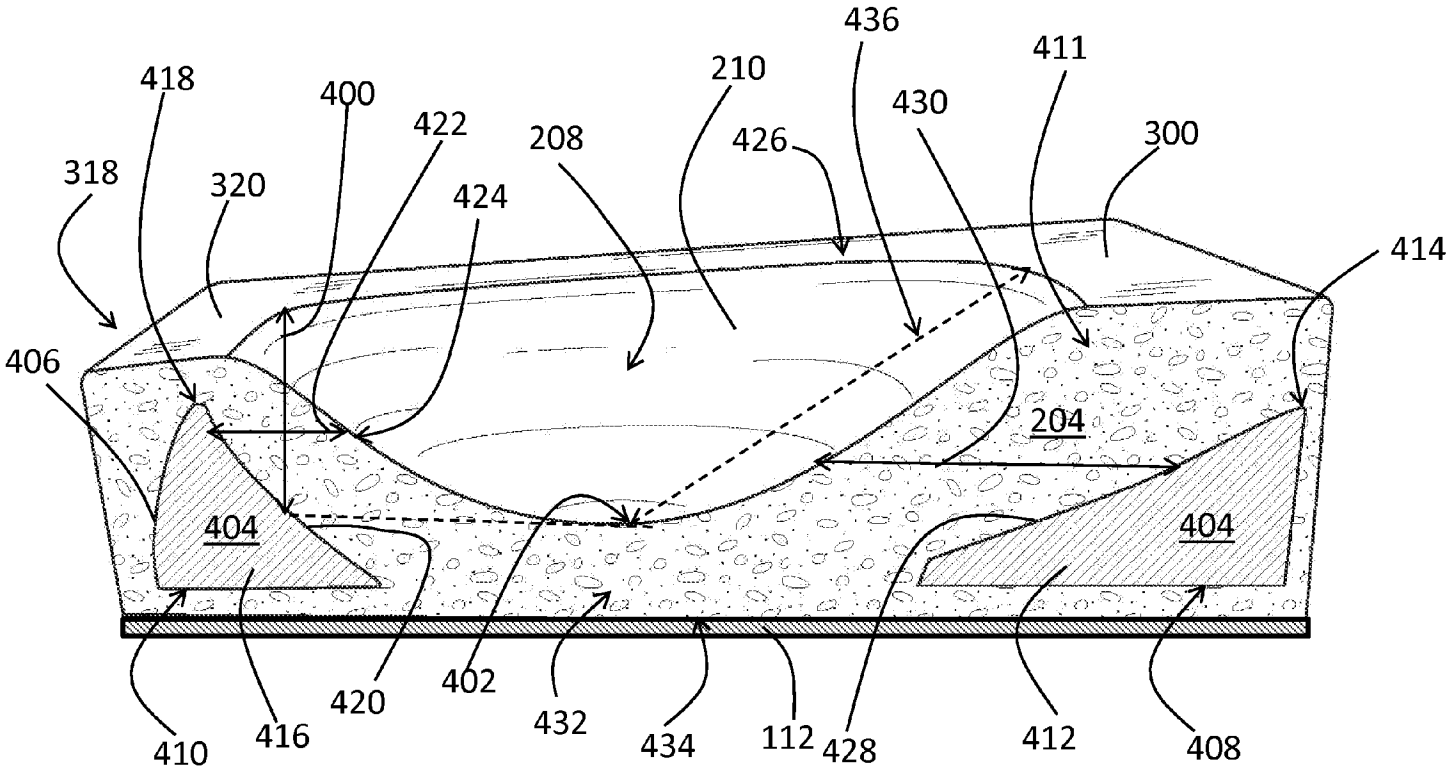
FIG. 4 is a cross-sectional side perspective view of the weight-displacing knee pad of FIG. 1 taken at line 4-4 in accordance with the present invention.

Referring to FIG. 4, with brief reference to FIG. 1, the knee-pad body 104 is shown in a cross-sectional, side perspective view taken at line 4-4 in FIG. 3, illustrating many of the advantageous features of the present invention. In one embodiment, the ridge 320 includes a height 400 relative to a bottom-most surface 402 of the knee-receiving cavity 208. In a further embodiment, the height 400 is sufficient to prevent a user's knee from moving in a forward direction 116 outside of the knee-receiving cavity 208 when the user 102 is in the kneeling position and leaning forward with the user's knee inserted into the knee-receiving cavity 208 and the user's shin resting on the shin-receiving surface 300. In one embodiment, the height 400 is sufficient to prevent the user's knee from moving outside of the knee-receiving cavity 208 when the user 102 is in the kneeling position and leaning forward about 25 degrees relative to a vertical axis 118 defined by the user's center of gravity. In another embodiment, the height 400 is sufficient to prevent the user's knee from moving outside of the knee-receiving cavity 208 when the user 102 is in the kneeling position and leaning forward about 45 degrees relative to the vertical axis 118. In a further embodiment, the height 400 is sufficient to prevent the user's knee from moving outside of the knee-receiving cavity 208 when the user 102 is in the kneeling position and leaning forward about 90 degrees relative to the vertical axis 118. In yet a further embodiment, the height 400 is outside of these ranges. Preferably, the height 400 is sufficient to prevent the user's knee from moving outside of the knee-receiving cavity 208 when the user 102 is in the kneeling position and leaning forward at any angle so as to provide the user 102 with comfortable knee and shin support in a multitude of work-related positions.

Referring now primarily to FIG. 4, in addition to the outer cushion member 204, the knee-pad body 104 further includes an inner member 404. In one embodiment, the inner member 404 is substantially enclosed on all sides thereof by the outer cushion member 204. In another embodiment, the outer cushion member 204 is molded onto an exterior surface 406 of the inner member 404 so as to substantially enclose the inner member 404 on all sides thereof. In a further embodiment, the molding process occurs by placing the inner member 404 within a mold and then pouring liquid foam into the mold so that the liquid foam forms over and around the inner member 404 substantially enclosing the inner member 404 as the inner member 404 cures, or solidifies into a solid dense foam material. As used herein, the term "substantially enclosed" is defined as to surround on substantially all sides and may include a nominal opening on one or more sides, where "substantially all sides" means surrounded by all sides or at least all but one side. In other embodiments, the molding process may be an extrusion blow molding or injection molding process. In one embodiment, the inner member 404 is enclosed by the outer cushion member 204 on all sides except the bottom surface. In this embodiment, the bottom surface of the inner member 404 is enclosed by the rubber shield 112 such that at least a bottom portion of the inner member 404 directly contacts the rubber shield 112.

In one embodiment, the inner member 404 is made of a different material than the outer cushion member 204. In another embodiment, the inner member 404 is made of a material that is more rigid than a material from which the outer cushion member 204 is made. In a further embodiment, the inner member 404 is made of a material that is substantially more rigid than the material from which the outer cushion member 204 is made. For example, in one embodiment, the inner member 404 may be made of a plastic material and the outer cushion member 204 may be made of a soft foam material. The soft foam material may be a flexible polyurethane foam material supplied by BJB enterprises. In a preferred embodiment, the inner member 404 is made of a substantially rigid material and the outer cushion member 204 is made of a soft, flexible material. In one embodiment, the inner member 404 is made of a substantially rigid foam material. In another embodiment, the inner member 404 is made of a substantially rigid plastic material. In yet another embodiment, the inner member 404 is made of another polymer-based material that is substantially rigid. In a further embodiment, the inner member 404 is made of yet another non polymer-based material that is substantially rigid. The term "substantially rigid" is intended to indicate a material of the inner member 404 that is not appreciably deformed when the user's body weight is placed thereon. Stated another way, a substantially rigid material is devoid of appreciable flexibility when the user's body weight is placed thereon in a typical use of the knee pad.

In one embodiment, at least a portion of the inner member 404 includes a shin-support body 408 and a forward knee-barrier support body 410. In another embodiment, the shin-support body 408 is disposed beneath the shin-receiving surface 300, together defining a shin support zone 411. The shin support zone 411 may provide a rigid support structure beneath a layer of the outer cushion member 204 to support the user's body weight as it is shifted from the knee area to the shin area. In yet another embodiment, the shin-support body 408 is disposed directly beneath the shin-receiving surface 300. In yet a further embodiment, the shin-support body 408 includes a triangular cross-section 412 with an apex 414 extending upwardly toward the shin-receiving surface 300. In yet a further embodiment, the apex 414 is disposed beneath the shin-receiving surface 300. As used herein, the term "apex" is defined as the highest point of a triangular body. Stated another way, the "apex" is the point of the triangular cross-section that is the closest to the shin-receiving surface 300. As used herein, the term "triangular" is intended to indicate a shape resembling a triangle and also encompassing trapezoidal shapes resembling a triangle. Although, the triangular cross-section 412 depicted in FIG. 4 has a substantially rectilinear shape, i.e., formed by straight lines, it is understood that the triangular cross-section 412 may, in some embodiments, be curvilinear, i.e., formed by curved lines. Advantageously, the apex 414 provides support for the user's shin, while allowing the user 102 (see FIG. 1) to adjust the angle of the shin relative to the apex 414, similar to the way a lever pivots at a fulcrum.

Figure 5:
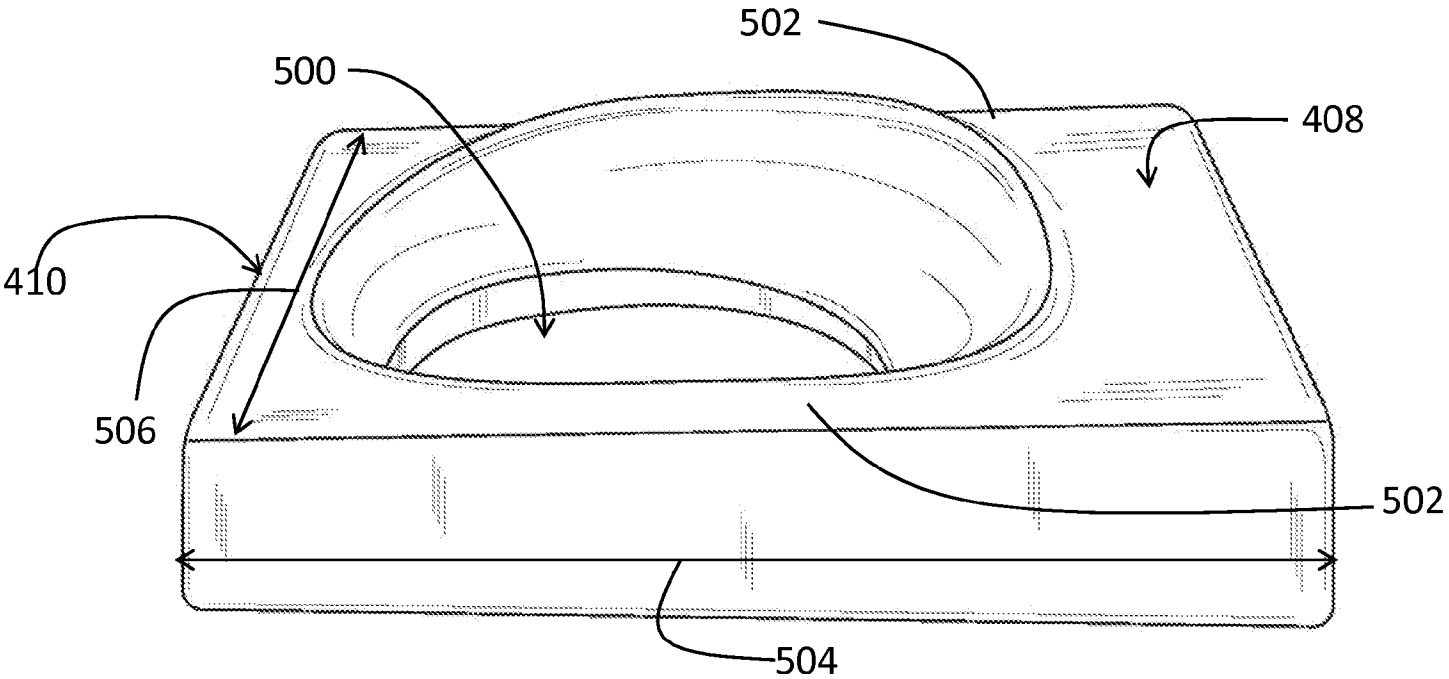
FIG. 5 is a partial, side perspective view of the weight-displacing knee pad of FIG. 1, showing an exemplary embodiment of the inner rigid member in accordance with the present invention.

In one embodiment, the forward knee-movement barrier 318 includes the forward knee-barrier support body 410. In another embodiment, the forward knee-barrier support body 410 is disposed beneath an upper surface of the ridge 320. The forward knee-barrier support body 410 may provide a rigid wall beneath a layer of the outer cushion member 204 to prevent the user's knee from slipping outside of the knee-receiving cavity 208. In yet another embodiment, the forward knee-barrier support body 410 is disposed directly beneath the ridge 320. In yet a further embodiment, the forward knee-barrier support body 410 is defined by at least a portion of the inner member 404. Stated another way, at least a portion of the inner member 404 includes the forward knee-barrier support body 410. In one embodiment, the inner member 404 includes the forward knee-barrier support body 410 and the shin support body 408. In another embodiment, the forward knee-barrier support body 410 and the shin support body 408 of the inner member 404 are formed integrally with one another, being a unitary body, as depicted in FIG. 5.

In one embodiment, the forward knee-barrier support body 410 includes a triangular cross-section 416 with an apex 418 extending upwardly toward the ridge 320. In another embodiment, the apex 418 is disposed beneath the ridge 320. Although, the triangular cross-section 416 depicted in FIG. 4 has a substantially rectilinear shape, i.e., formed by straight lines, it is understood that the triangular cross-section 416 may, in some embodiments, be curvilinear, i.e., formed by curved lines. In yet another embodiment, the forward knee-barrier support body 410 includes a knee-barrier wall 420 disposed a separation distance 422 from an exterior surface 424 of the concave-shaped wall 210. The knee-barrier wall 420 can provide a rigid barrier that prevents the user's knee from slipping forward outside of the knee-receiving cavity 208.

In one embodiment, the knee-receiving cavity 208 defines the height 400 or distance between a bottom-most surface 402 of the knee-receiving cavity 208 and an upper rim 426 of the knee-receiving cavity 208. In another embodiment, the knee-receiving cavity 208 is about 1.25 inches in depth from the bottom-most surface 402 of the knee-receiving cavity 208 to an upper rim 426 of the knee-receiving cavity 208. In other embodiments, the knee-receiving cavity 208 includes a depth that is outside of this range. In yet another embodiment, the apex 414 of the shin-support body 408 extends upwardly to at least one-half of the distance 400. In yet another embodiment, the apex 414 of the shin-support body 408 extends upwardly to beyond one-half of the distance 400. In another embodiment, the apex 414 extends upwardly to at least three-fourths of the distance 400. In yet other embodiments, the apex 414 extends upwardly to a distance that is outside of these ranges. In a further embodiment, the shin-support body 408 includes a shin-support wall 428 disposed a separation distance 430 from the concave-shaped wall 210.

In one embodiment, the concave-shaped wall 210 is shaped so that the curved portion 436 extending from the bottom-most surface 402 of the knee-receiving cavity 208 to an edge of the shin-receiving surface 300 is about 15 degrees with respect to a horizontal axis parallel to a ground surface. This is because when a user kneels on a ground surface, the user's lower leg, i.e. the portion of the user's leg extending from the knee to the shin area, is typically not parallel with the ground surface. Rather, the user's lower leg is normally at about 15 degrees with respect to the ground surface. Existing knee pads do not account for this. In another embodiment, the curved portion 436 may be outside of this range.

In one embodiment, the knee-pad body 104 includes a rigid-free cushion zone 432 between the bottom-most surface 402 of the knee-receiving cavity 208 and the rubber shield 112 disposed on the bottom, floor-engaging portion of the knee-pad body 104. In one embodiment, the rigid-free cushion zone 432 is made of only the outer cushion member 204 and does not include a layer of the inner member 404, which is preferably rigid. Advantageously, the rigid-free cushion zone 432 provides a soft pliable section for receiving and comfortably supporting a user's knee thereon. In a further embodiment, the rigid-free cushion zone 432 extends downwardly from the bottom-most surface 402 of the knee-receiving cavity 208 to the bottom-most end 434, or floor, of the knee-pad body 104. In another embodiment, the rigid-free cushion zone 432 includes a thickness of about ⅜$^{ths}$ of an inch. In yet another embodiment, the rigid-free cushion zone 432 includes a thickness of about ¾$^{ths}$ of an inch. In a further embodiment, the rigid-free cushion zone 432 includes a thickness outside of these ranges.

Referring to FIG. 5, with reference to FIG. 4, an exemplary embodiment of the inner member 404 is shown in a top perspective view. In one embodiment, the inner member 404 defines an aperture 500, or through-hole. In another embodiment, the outer cushion member 204 extends through the aperture 500 so as to form the knee-receiving cavity 208 and the rigid-free cushion zone 432, as can be seen in FIG. 4. In yet another embodiment, the inner member 404 can be considered a rigid skeleton or rigid framework that frames the knee and holds it in place, while the knee-receiving cavity 208 and the rigid-free cushion zone 432 provide a soft cushion for the knee. Because the user's weight is shifted to the shin area, the knee rests very comfortably on the rigid-free cushion zone 432 with very little to no weight pressing down on the knee. In addition, the knee is secure within the knee-receiving cavity 208 because it is framed by the rigid inner member 404. In another embodiment, the aperture 500 is sized and shaped to conform to the shape of the user's knee. In one embodiment, the inner member 404 can be seen as defining a plateau on the top surface with a valley in the middle, as depicted in FIG. 5. In another embodiment, the inner member 404 may define a curve-shaped or hill-like top surface with a valley in the middle.

In one embodiment, the inner member 404 extends circumferentially about the concave-shaped wall 210 of the outer cushion member 204. In another embodiment, the inner member 404 includes a pair of inner member sidewalls 502. In yet a further embodiment, each of the pair of inner member sidewalls 502 is disposed on opposing sides of the concave-shaped wall 210 of the outer cushion member 204. In another embodiment, the pair of inner member sidewalls 502, the forward knee-barrier support body 410, and the shin-support body 408 are formed integrally with one another. Stated another way, the inner member 404 includes the pair of inner member sidewalls 502, the forward knee-barrier support body 410, and the shin-support body 408 together, being formed as a unitary body. In yet another embodiment, the inner member 404 does not extend across an area directly beneath the knee-receiving cavity 208 so that the knee does not rest on a rigid body, either directly or indirectly. Stated another way, the inner member 404 circumscribes the knee-receiving cavity 208 so as to define the rigid-free cushion zone 432 for the user's knee when inserted within the knee-receiving cavity 208. As used herein, the term "circumscribe" is defined as to enclose within bounds. In yet a further embodiment, the inner member 404 is sized, shaped, and dimensioned to be about $1/8^{ths}$ of an inch smaller than the outer cushion member 204 on all sides thereof. In yet a further embodiment, the inner member 404 is about 7.25 inches in length 504 and about 4.5 inches in width 506. In other embodiments, the inner member 404 is outside of these ranges.

A novel and inventive knee pad has been disclosed that displaces the weight of the user from the knee area to the shin. In addition, embodiments of the invention provide for a knee pad having a rigid inner member that conforms to the shape of the knee. In a further embodiment, liquid foam is poured into a mold including the rigid inner member so that the foam forms over the rigid inner member substantially enclosing the inner rigid member as it hardens, resulting in a knee pad body with a shin-support section where the rigid inner member provides sufficient support and a soft, pliable knee-receiving cushion section. In yet a further embodiment, the rigid inner member provides a rigid framework or skeleton that frames the knee so as to hold the knee securely in place, while defining a rigid-free knee-receiving cushion zone within an aperture of the framework. In addition, the knee pad includes a lip or ridge that prevents the knee from slipping forward at an angle.

What is claimed is:

1. A weight-displacing knee pad comprising:

a knee-pad body including an inner member and an outer cushion member, the outer cushion member having an exterior surface defining a knee-receiving cavity and a shin-receiving surface and at least a portion of the inner member having a shin-support body disposed beneath the shin-receiving surface, at least a portion of the shin-support body including a triangular cross-section with a first apex extending upwardly toward the shin-receiving surface, the inner member being of a different material than the outer cushion member.

2. The weight-displacing knee pad in accordance with claim 1, wherein:

the inner member is of a material that is more rigid than a material from which the outer cushion member is made of.

3. The weight-displacing knee pad in accordance with claim 1, wherein:

the inner member is substantially enclosed by the outer cushion member.

4. The weight-displacing knee pad in accordance with claim 1, wherein:

the outer cushion member is molded onto an exterior surface of the inner member so as to substantially enclose the inner member.

5. The weight-displacing knee pad in accordance with claim 1, wherein:

the knee-pad body further includes a forward knee-movement barrier having a ridge including a height relative to a bottom-most surface of the knee-receiving cavity, the height being sufficient to prevent a user's knee from moving in a forward direction outside of the knee-receiving cavity when the user is in a forward leaning, kneeling position with the user's knee inserted into the knee-receiving cavity and the user's shin resting on the shin receiving surface.

6. The weight-displacing knee pad in accordance with claim 5, wherein:

the forward knee-movement barrier includes a forward knee-barrier support body disposed beneath an upper surface of the ridge, the forward knee-barrier support body defined by at least a portion of the inner member and including a triangular cross-section with a second apex extending upwardly toward the ridge.

7. The weight-displacing knee pad in accordance with claim 6, wherein:

the shin-support body and the forward knee-barrier support body of the inner member are formed integrally with one another.

8. The weight-displacing knee pad in accordance with claim 1, wherein:

the knee-receiving cavity defines a distance between a bottom-most surface of the cavity and an upper rim of the cavity; and the first apex of the shin-support body extends upwardly to least one-half of the distance.

9. The weight-displacing knee pad in accordance with claim 1, further comprising:

a concave-shaped wall defining the knee-receiving cavity, the inner member extending circumferentially about the concave-shaped wall and including a pair of inner member sidewalls on opposing sides of the concave-shaped wall, the pair of inner member sidewalls and the shin-support body formed integrally with one another.

10. The weight-displacing knee pad in accordance with claim 1, wherein:

the inner member circumscribes the knee-receiving cavity so as to define an aperture for receiving at least a portion of the outer cushion member therethrough, the at least a portion the outer cushion member forming a rigid-free cushion zone for a user's knee when inserted within the knee-receiving cavity.

11. A weight-displacing knee pad comprising:

an outer cushion member, the outer cushion member having an exterior surface defining a knee-receiving cavity and a shin-receiving surface; and an inner member of a substantially rigid material, the inner member:

having a shin-support body disposed beneath the shin-receiving surface of the outer cushion member so as to define a shin support zone and at least a portion of the shin-support body includes a triangular cross-section with a first apex extending upwardly toward the shin-receiving surface; and circumscribing the knee-receiving cavity so as to define an aperture for receiving at least a portion of the outer cushion member therethrough, the at least a portion the outer cushion member forming a rigid-free cushion zone for a user's knee when inserted within the knee-receiving cavity.

12. The weight-displacing knee pad in accordance with claim 11, wherein:

the outer cushion member is of a foam material.

13. The weight-displacing knee pad in accordance with claim 11, wherein:

the inner member is substantially enclosed by the outer cushion member.

14. The weight-displacing knee pad in accordance with claim 11, further including:

a forward knee-movement barrier having a ridge including a height relative to a bottom-most surface of the knee-receiving cavity, the height being sufficient to prevent a user's knee from moving in a forward direction outside of the knee-receiving cavity when the user is in a forward leaning, kneeling position with the user's knee inserted into the knee-receiving cavity and the user's shin resting on the shin receiving surface.

15. The weight-displacing knee pad in accordance with claim 14, wherein:

the forward knee-movement barrier includes a forward knee-barrier support body disposed beneath an upper surface of the ridge, the forward knee-barrier support body defined by at least a portion of the inner member and including a triangular cross-section with a second apex extending upwardly toward the ridge.

16. The weight-displacing knee pad in accordance with claim 15, wherein:

the shin-support body and the forward knee-barrier support body of the inner member are formed integrally with one another.

17. The weight-displacing knee pad in accordance with claim 12, wherein:

the knee-receiving cavity defines a distance between a bottom-most surface of the cavity and an upper rim of the cavity; and the first apex of the shin-support body extends upwardly beyond at least one-half of the distance.

18. The weight-displacing knee pad in accordance with claim 11, further comprising:

a concave-shaped wall defining the knee-receiving cavity, the inner member extending circumferentially about the concave-shaped wall and defining a pair of inner member sidewalls on opposing sides of the concave-shaped wall, the pair of inner member sidewalls and the shin-support body formed integrally with one another.

19. A weight-displacing knee pad comprising:

an outer cushion member, the outer cushion member having an exterior surface defining a knee-receiving cavity and a shin-receiving surface; and an inner member substantially enclosed by the outer cushion member, at least a portion of the inner member having a shin-support body disposed beneath the shin-receiving surface, at least a portion of the shin-support body including a triangular cross-section with a first apex extending upwardly toward the shin-receiving surface; and a forward knee-movement barrier disposed on a side of the knee-receiving cavity that is opposite a side of the knee-receiving cavity where the shin-receiving surface is disposed, the forward knee-movement barrier including a forward knee-barrier support body defined by at least a portion of the inner member and including a triangular cross-section with a second apex extending upwardly toward a ridge of the forward knee-movement barrier.

* * * * *